United States Patent [19]

Harder, Jr.

[11] 4,270,798

[45] Jun. 2, 1981

[54] BREAKAWAY ARM FOR SEAT

[75] Inventor: Arthur J. Harder, Jr., Franklin Park, Ill.

[73] Assignee: Coach & Car Equipment Corporation, Elk Grove Village, Ill.

[21] Appl. No.: 56,330

[22] Filed: Jul. 10, 1979

[51] Int. Cl.[3] ..... A47C 7/54

[52] U.S. Cl. ..... 297/417

[58] Field of Search ..... 297/417, 162

[56] References Cited

U.S. PATENT DOCUMENTS

| | | | |
|---|---|---|---|
| 3,197,254 | 7/1965 | Hendrickson | 297/162 |
| 3,374,032 | 3/1968 | Del Giudice | 297/417 |
| 3,544,163 | 12/1970 | Krein | 297/417 |
| 3,951,452 | 4/1976 | Harder | 297/417 |

*Primary Examiner*—Francis K. Zugel

*Attorney, Agent, or Firm*—Merriam, Marshall & Bicknell

[57] ABSTRACT

A seat for a vehicle operator includes an occupant-supporting portion, a back and an armrest. The armrest is pivotable through a vertical plane between a horizontally extending, arm-supporting position and an upwardly extending position alongside the seat back. The armrest is also pivotable, in response to a predetermined outwardly directed force against the armrest, through a horizontal plane, between the above-described arm-supporting position and a position in which the armrest extends rearwardly from the seat back. Structure is provided which normally urges the armrest from its rearwardly extending position to a downwardly extending position alongside the seat.

7 Claims, 10 Drawing Figures

20
21
22
23
24
25
27
28
29
30
5
5
29
69
70
71
85
87
88
84
86
57
58
59
60
83
82
62
53
75
77
52
54
64
55
56
65
66
43
79
45
42
44
27
47
46
49
48
36
39
90
37
35
91
38
25

FIG. 7
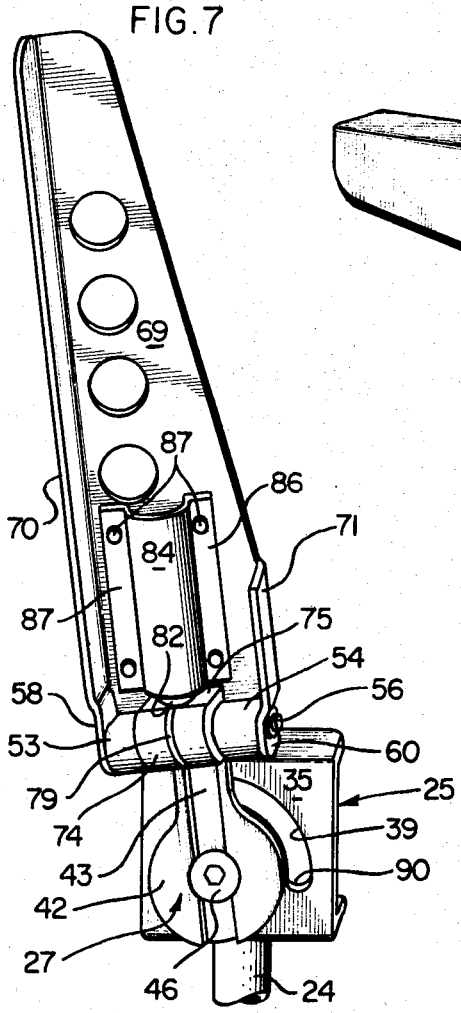
FIG. 8
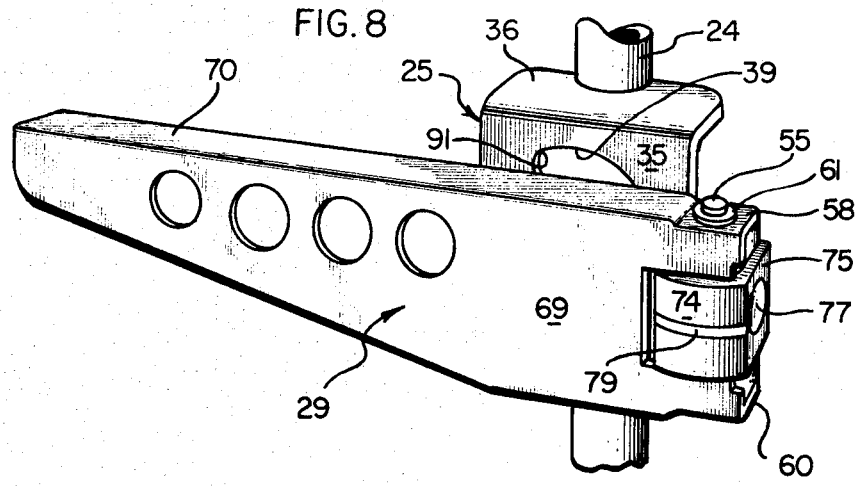
FIG. 9
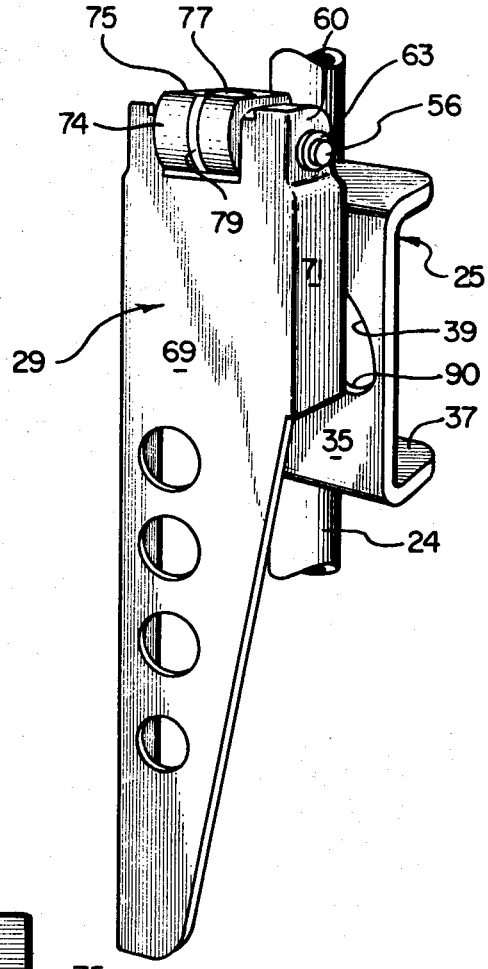
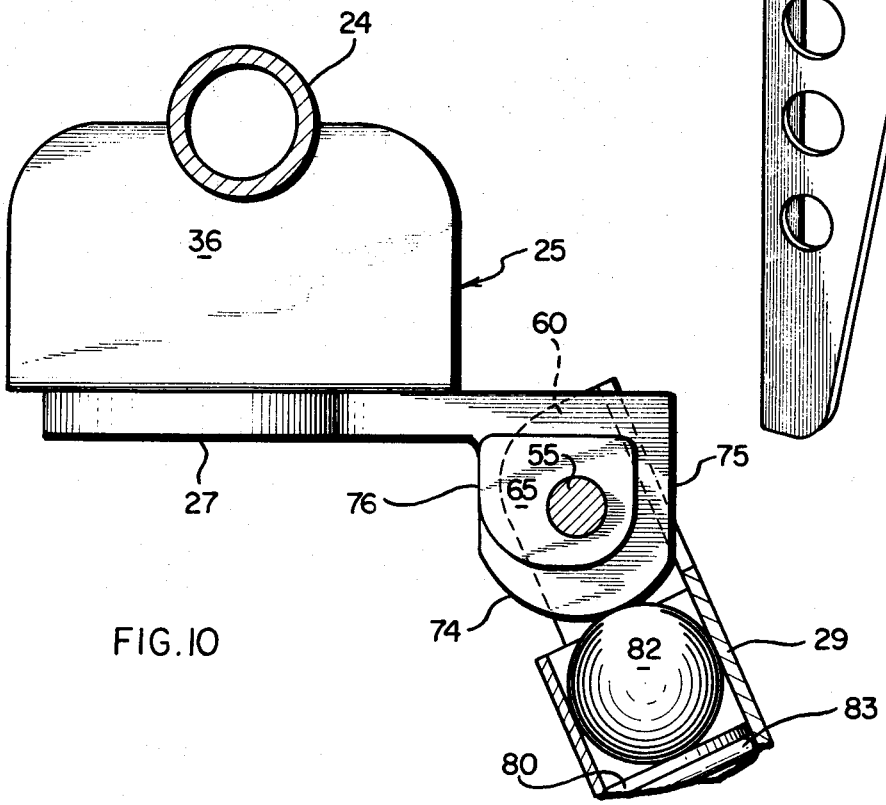
FIG. 10

BREAKAWAY ARM FOR SEAT

BACKGROUND OF THE INVENTION

The present invention is directed generally to seats with armrests and more particularly to a seat with an armrest that may be pivoted to an out-of-the-way position to permit the occupant of the seat to leave the seat via the side of the seat.

Seats with armrests of this type are typically provided for vehicle operators who must enter or leave the seat from the side, generally because there is a console or dashboard with vehicle operating equipment located in front of the seat, thereby precluding entry to or exit from the seat via the front. A typical situation would be in the cab of a locomotive. Because the occupant of the seat will be required to sit in the seat for extended periods of time while he is operating the vehicle, it is desirable to provide an armrest for the occupant. Normally, such armrests are mounted for pivotal movement through a vertical plane between a horizontally extending position for supporting the arm of the seat occupant and a vertically disposed position, in which the armrest extends upwardly alongside the back of the seat, to permit the seat occupant to enter or leave the seat.

It is sometimes desirable, as in an emergency situation, for the occupant to leave the seat rapidly. In such a situation, the desired action for displacing the armrest to a non-obstructing, exit-permitting position is to push outwardly against the armrest. This action is faster and less involved than pivotally raising the armrest through a vertical plane because the former can be accomplished simultaneously with, and as a part of, the act of exiting. Accordingly, seats of this type are provided with armrests which, in addition to pivoting through a vertical plane to an out-of-the-way position, also pivot through a horizontal plane away from the seat to permit rapid exit by the seat occupant.

An armrest of this type is disclosed in Harder U.S. Pat. No. 3,951,452. Such armrests are called breakaway armrests because they require striking the armrest a sidewards blow with a predetermined "breakaway" force to displace the armrest from its normal horizontally extending, arm-supporting position.

SUMMARY OF THE INVENTION

It is desirable that such breakaway armrests be sturdy, unflimsy, failsafe, and reusable again and again. It is also important that these armrests not break off or bend out of shape during the breakaway act. A breakaway armrest in accordance with the present invention has all of the desirable features described in the preceding sentence.

Other features and advantages are inherent in the structure claimed and disclosed or will become apparent to those skilled in the art from the following detailed description in conjunction with the accompanying diagrammatic drawings.

BRIEF DESCRIPTION OF THE DRAWINGS

FIG. 7 is a perspective showing the breakaway armrest in a vertical disposition for permitting an occupant to enter or leave the seat;

FIG. 8 is a perspective illustrating the breakaway armrest pivoted through a horizontal plane from the arm-supporting position of FIG. 6 to an intermediate out-of-the-way position;

FIG. 9 is a perspective illustrating the breakaway armrest pivoted through a vertical plane from the intermediate out-of-the-way position of FIG. 8 to a final out-of-the-way position; and FIG. 10 is a sectional view illustrating a portion of the breakaway armrest in the course of being pivoted between the position of FIG. 6 and the position of FIG. 8.

DETAILED DESCRIPTION

Figures 1, 2:
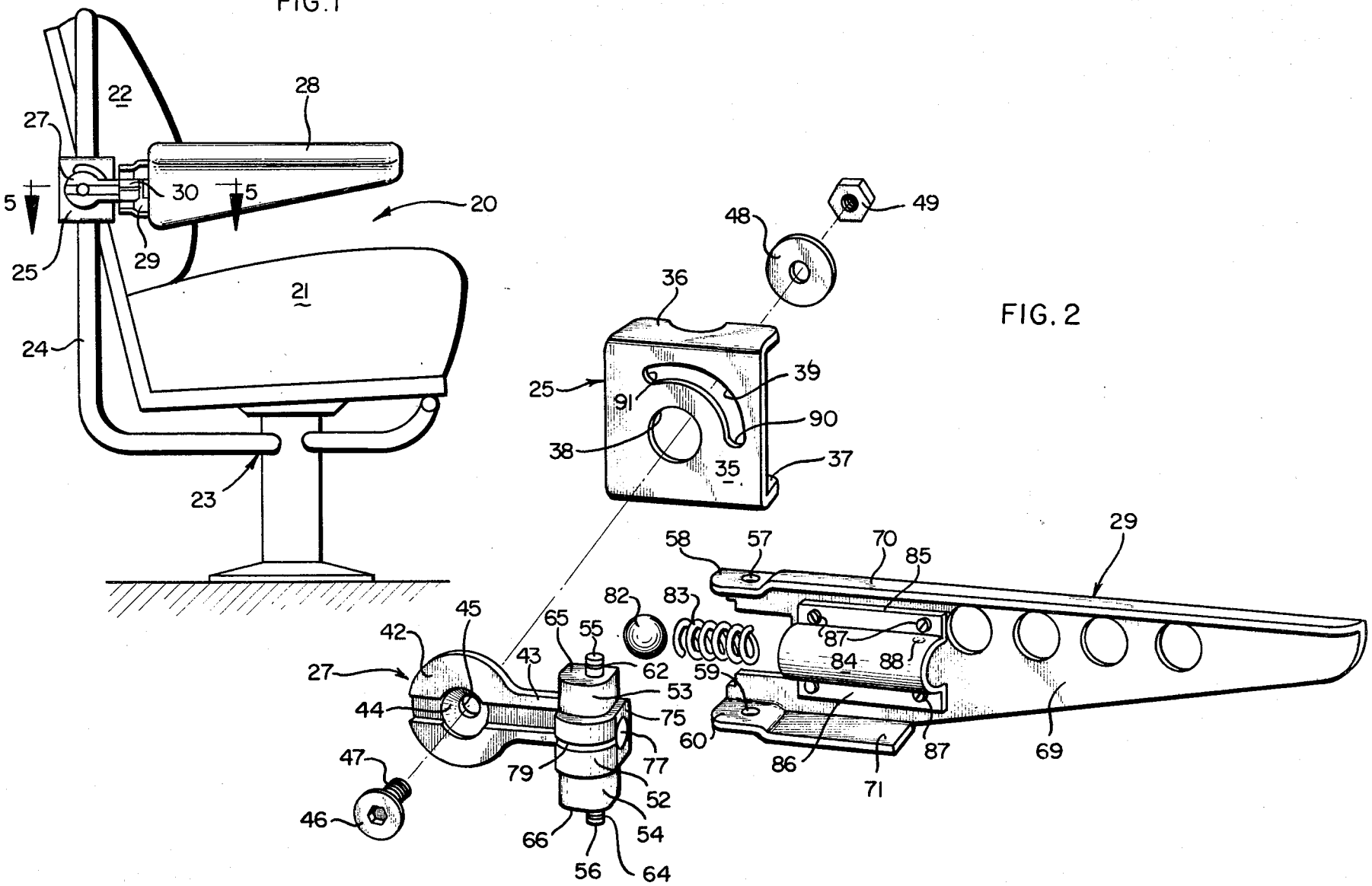
FIG. 1 is a side elevational view of a seat having a breakaway armrest in accordance with an embodiment of the present invention.
FIG. 2 is an exploded perspective of an embodiment of the breakaway armrest in accordance with the present invention.

Referring initially to FIG. 1, indicated generally at 20 is a seat comprising an occupant-supporting portion 21 and a backrest 22 supported by a rigid frame 23 mounted on a pedestal 26 and comprising a vertical frame member 24 to which is attached, as by welding, a bracket 25. A link member 27 is mounted on bracket 25 for pivotal movement of the link member relative to rigid frame 23 and bracket 25, through a vertical plane, between (1) a horizontal disposition, shown in FIGS. 1 and 6, and (2) a vertical disposition shown in FIG. 7.

An armrest 28 including an armrest frame member 29 is connected to the link member for unitary movement of armrest 28 with link member 27 about the pivotal axis of the link member.

Armrest 28 is also mounted for arcuate movement through a second or horizontal plane, transverse to the vertical plane through which the link member moves, and about a pivotal axis transverse to the pivotal axis of the link member, between a first position, in which the armrest with its frame member 29 constitute an extension of the link member (FIGS. 1 and 6) and a second position in which the armrest is folded back alongside the link member (FIGS. 8 and 9).

The weight of the armrest 28 normally urges link member 27 toward its horizontal disposition (FIGS. 1 and 6) when armrest 28 is in its first position (FIGS. 1 and 6), while the weight of the armrest urges link member 27 toward the downwardly extending vertical disposition of FIG. 9 once the armrest is in its second position folded back alongside the link member (FIG. 8).

Located at the junction of armrest frame member 29 and link member 27 is locking structure, indicated generally at 30 in FIG. 1. Locking structure 30 is unlockable in response to a predetermined breakaway or unlocking force exerted against armrest 28 in the direction of arcuate movement of the armrest through its horizontal plane of pivotal movement. Locking structure 30 normally holds the armrest in its first or second position (FIG. 6 and FIGS. 8 and 9 respectively), the armrest being displaceable from either of its first or second positions only in response to application of the predetermined unlocking force described above.

Figure 5:
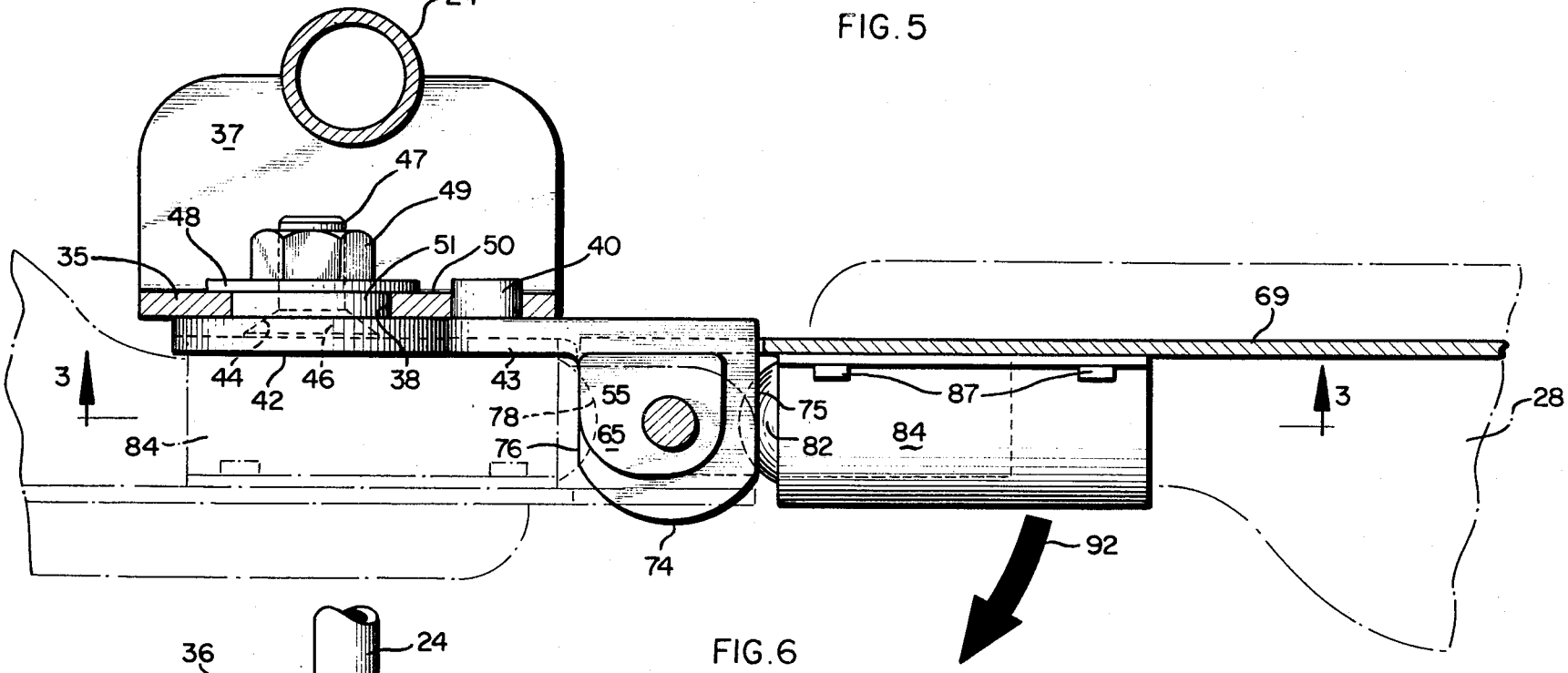
FIG. 5 is a sectional view taken along line 5—5 in FIG. 1.

Referring to FIG. 2, bracket 25 has a U-shaped cross section and comprises a web 35 and a pair of notched flanges 36, 37 welded to vertical frame member 24 (FIG. 5). Bracket web 35 has a circular opening 38 and an arcuate slot 39. Referring to FIGS. 2–3 and 5–6, link member 27 comprises a disc-shaped portion 42 from which extends a finger 43. Extending from disc-shaped portion 42 towards bracket 25 is a bearing portion 51 which is received within circular opening 38 in bracket web 35 to mount link member 27 for pivotal movement about the axis of circular opening 38.

Bearing portion 51 contains a circular recess 44 having a hole 45. Circular recess 44 receives the head 46 of a threaded fastener 47 extending through hole 45. Mounted on threaded fastener 47 is a washer 48 held in place against the back surface 50 of bracket web 35 by a nut 49. Threaded member 47 and nut 49 hold link member 27 in position, pivotally mounted on bracket 25. When link member 27 is mounted on bracket 25, in the manner described above, a pin 40 on finger 43 of link member 27 extends through and engages within arcuate slot 39 on web 35 of bracket 25.

Figure 3:
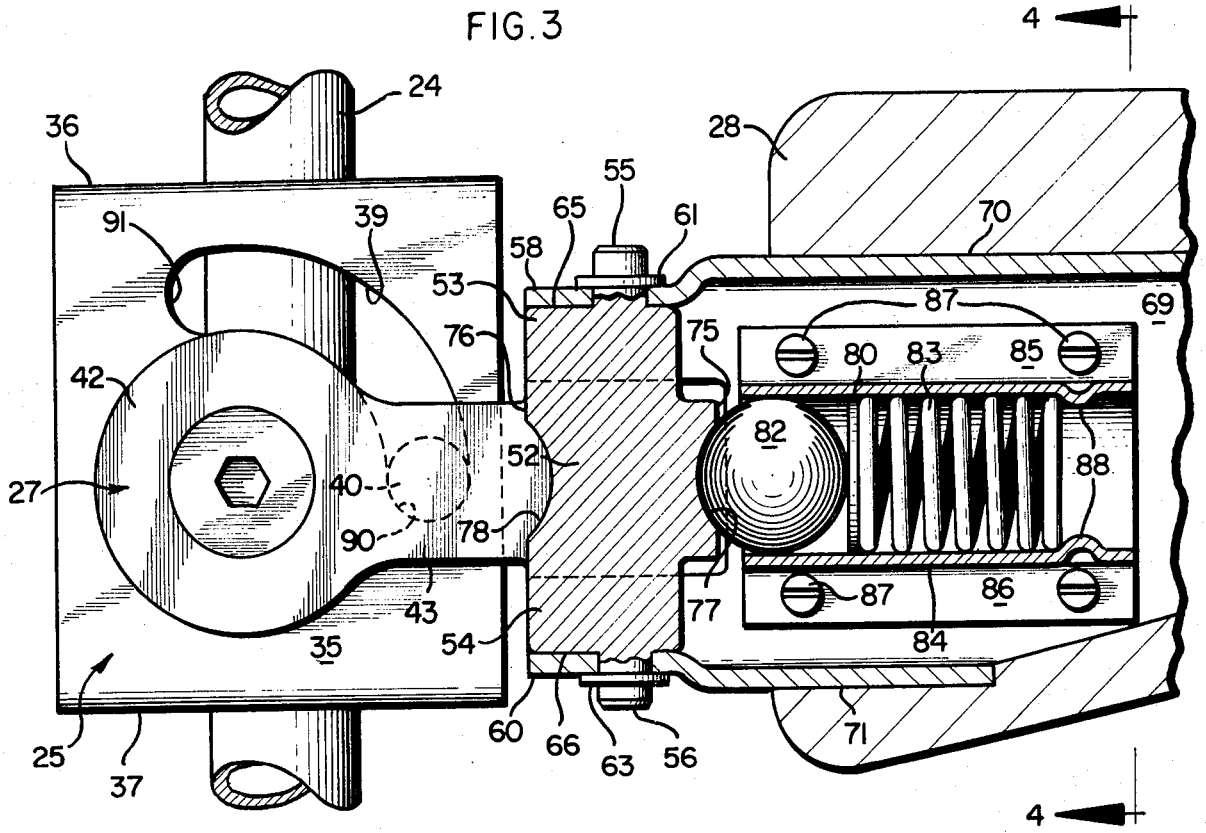
FIG. 3 is an enlarged, fragmentary, sectional view of the armrest, taken along line 3—3 in FIG. 5.
Figure 4:
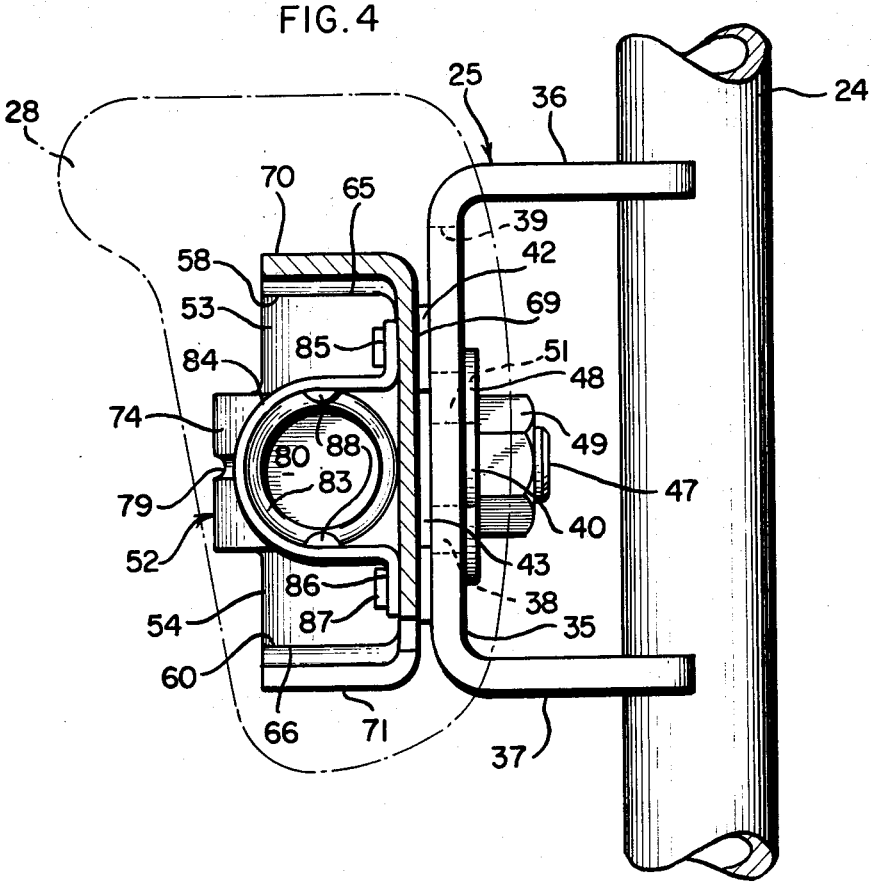
FIG. 4 is a sectional view taken along line 4—4 in FIG. 3.

Link member 27 is connected to armrest frame member 29 by structure now to be described (FIGS. 2, 3, 5 and 6). Located at the terminal end of finger 43 is a bearing element 52 the function of which will be described later. Integral with bearing element 52 are an upper extension 53 and a lower extension 54. Located on extensions 53, 54 are respective upper and lower pin portions 55, 56. Upper pin portion 55 is received in an opening 57 in an upper ear 58 on armrest frame member 29, and lower pin portion 56 is received in an opening 59 in a lower ear 60 on armrest frame member 29. A snap ring 61 engages within a slot 62 on upper pin portion 55, and a snap ring 63 engages in a slot 64 on lower pin portion 56 to lock armrest frame member 29 in place on pin portions 55, 56 (FIG. 3). An upper surface 65 on upper extension 53 and a lower surface 66 on lower extension 54 engage upper and lower ears 58, 60, respectively, on armrest frame member 29 to limit upward and downward movement of armrest frame member 29 along the axis of pin portion 55, 56. The mounting arrangement described above mounts armrest frame member 29 for pivotal movement about the common axis of pin portion 55, 56.

Armrest frame member 29 comprises a web 69, an upper flange 70 integral with upper ear 58 and a lower flange 71 integral with lower ear 60. Ears 58 and 60 are indented relative to their respective integral flanges 70, 71.

Figure 6:
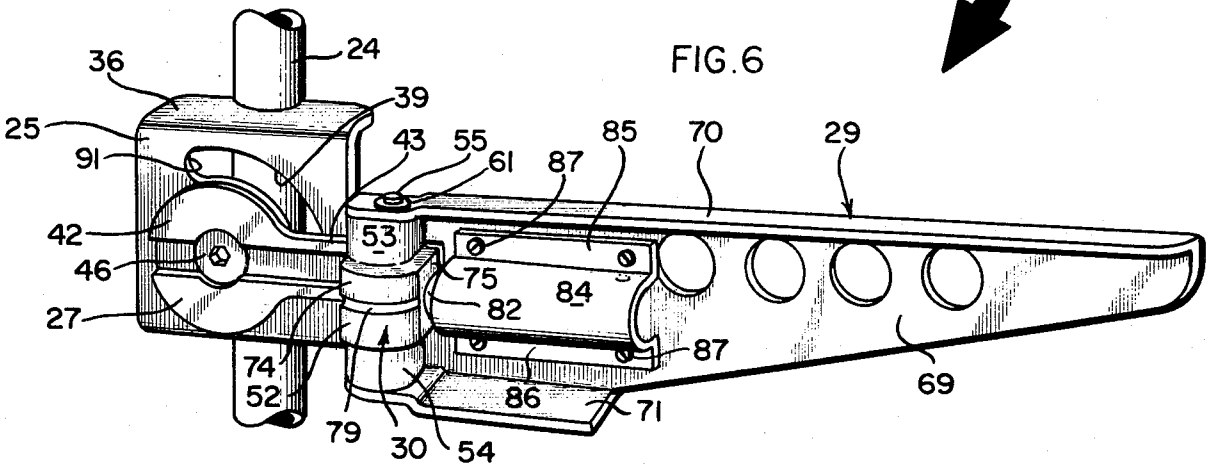
FIG. 6 is a perspective showing the breakaway armrest in an arm-supporting position.

As previously noted, located at the junction of link member 27 and armrest frame member 29 is locking structure indicated generally at 30 and normally holding armrest frame member 29 in either the position illustrated in FIG. 6, in which the armrest constitutes an extension of the link member, or in the position illustrated in FIGS. 8 and 9 in which the armrest is folded back alongside the link member. This locking structure will now be described in greater detail, with particular reference to FIGS. 2–7.

Included as part of locking structure 30 is bearing element 52 previously described as located at the terminal end of finger 43 on link member 27 (FIGS. 2–3). Bearing element 52 comprises an arcuate bearing race 74 having a groove 79. Located at one end of arcuate bearing race 74 is a flat surface 75 having a socket 77 therein, and located at the other end of bearing race 74 is a second flat surface 76 having a socket 78 therein. A bearing ball 82 is normally urged into socket 77 on flat surface 75 by a compressed coil spring 83 enclosed within a housing 84.

Housing 84 has a U-shaped cross section and has upper and lower integral flanges 85, 86 respectively, each of which is attached to web 69 of armrest frame member 29 by fasteners 87. Housing 84 comprises a pair of inwardly projecting detents 88, 88 which engage one end of spring 82. The opposite end of spring 82 engages a disc 80 located between bearing ball 82 and compressed spring 83. As shown in FIG. 3, a substantial portion of ball 82 is normally contained within housing 84.

First and second sockets 77, 78 are 180° apart along arcuate bearing race 74. Socket 77 receives ball 82 when armrest frame member 29 is in either the normally extended position illustrated in FIGS. 1 and 6 or the normally raised position illustrated in FIG. 7. Socket 78 receives ball 82 when armrest frame member 29 is in the positions illustrated in either FIGS. 8 or 9, in which the armrest frame member is folded alongside link member 27.

Armrest 28 with armrest frame member 29 is normally held in the arm-supporting position illustrated in FIGS. 1 and 6 by the engagement of pin 40 on link member 27 with the bottom end 90 of slot 39 on bracket web 35 (FIGS. 2, 3 and 5). When the armrest frame member is pivoted with link member 27 to the normally raised or elevated position illustrated in FIG. 7, pin 40 engages the upper end 91 of slot 39 to limit the upward pivotal movement of the link member and armrest frame member.

Normally, a seat occupant has the armrest in the arm-supporting position illustrated in FIGS. 1 and 6, and, when the seat occupant wishes to leave the seat, he normally elevates armrest 28 with frame member 29 to the elevated position illustrated in FIG. 7. However, in an emergency situation, to facilitate quick exit from the seat, the operator may move the armrest quickly out of the way merely by striking the inner surface of the armrest with an outwardly directed blow (in the direction of arrow 92 in FIG. 5). This causes armrest frame member 29 to pivot about the mutual axis of pin portions 55, 56 from the position illustrated in FIG. 6, through the position illustrated in FIG. 10, to the intermediate out-of-the-way position of FIG. 8 in which armrest frame member 29 extends rearwardly relative to the seat and alongside link member 27.

The breakaway or unlocking force necessary to displace the armrest frame member 29 from the position illustrated in FIG. 6 and to urge member 29 toward the position illustrated in FIG. 8 is the force necessary to overcome the urging of spring 83 normally pushing ball 82 into socket 77.

As armrest frame member 29 is pivoted from the position shown in FIG. 6 to the position shown in FIG. 8, ball 82 travels along arcuate bearing race 74 until it reaches socket 78 into which the ball is received when armrest frame member 29 is in the position illustrated in FIG. 8. Groove 79 in arcuate bearing race 74 extends from flat surface 75, at one end of the arcuate bearing race, to flat surface 76 at the other end of the arcuate bearing race and acts as a guide for ball 82 as it moves between sockets 77,78.

Once ball 82 is forcibly displaced from socket 77, it is relatively easy to move the ball along arcuate bearing race 74 until the ball reaches and seats in socket 78 whereat armrest frame member 29 is in the position illustrated in FIG. 8, folded back alongside link member 27. When ball 82 has been seated in socket 78, the armrest frame member and the link member maintain the folded relationship of FIG. 8 (and FIG. 9) until a force is exerted against the armrest frame member to pry ball 82 out of socket 78. This is equal to the force required to displace ball 82 from socket 77.

Once armrest frame member 29 is in the position illustrated in FIG. 8, the weight thereof will cause link member 27 to pivot, with armrest frame member 29 about the axis of opening 38 in bracket web 35, from the position illustrated in FIG. 8 to the final out-of-the-way position illustrated in FIG. 9. In the position of FIG. 9, both link member 27 and armrest frame 29 are in vertical dispositions, and the armrest frame member hangs downwardly alongside the seat. When members 27 and 29 are in the position illustrated in FIG. 9, pin 40 on link member 27 engages upper end 91 on slot 39 to limit further pivotal movement about the axis of opening 38.

When armrest frame member 29 is in the position illustrated in FIG. 9, it may be returned to its normal arm-supporting position (FIG. 6) by first manually rotating the armrest frame member about the axis of opening 38 in bracket web 35, from the position of FIG. 9 to the position of FIG. 8 and then manually pivoting the armrest frame member about the axis of pin portions 55, 56, from the position illustrated in FIG. 8, through the position illustrated in FIG. 10, back to the position illustrated in FIG. 6. During this latter pivotal movement, ball 82 is first forced out of socket 78, and the ball then rides along arcuate bearing race 74 until it again seats within socket 77 in flat surface 75 at the one end of arcuate bearing race 74.

As should be apparent from the foregoing, the breakaway armrest of the present invention is sturdy, unflimsy and failsafe. It may be reused again and again, and it won't break or bend out of shape during breakaway movement.

The foregoing detailed description has been given for clearness of understanding only, and no unnecessary limitations should be understood therefrom, as modifications will be obvious to those skilled in the art.

I claim:

1. In a seat having an occupant-supporting portion, a back and rigid frame, a breakaway armrest unit comprising:

a link member;

means mounting said link member for pivotal movement relative to said rigid seat frame, through a vertical first plane, between horizontal and vertical dispositions of the link member;

an armrest;

means connecting said armrest to said link member for unitary movement of the armrest with the link member about the pivotal axis of the link member;

said connecting means also comprising means mounting said armrest for arcuate movement through a second plane, transverse to said first plane, and about a pivotal axis transverse to the pivotal axis of said link member, between a first position, in which said armrest constitutes an extension of said link member, and a second position in which the armrest is folded back alongside said link member;

said armrest comprising gravity means for urging said link member toward its horizontal disposition when the armrest is in its first position and for urging the link member toward its vertical disposition when the armrest is in its second position;

a bearing element on said link member, adjacent said armrest;

said bearing element having an arcuate bearing race corresponding to the arc of movement of said armrest as it pivots between its first and second positions, said arcuate bearing race having a pair of opposite ends;

a bearing ball associated with said armrest;

means on said armrest for urging said bearing ball against said arcuate bearing race;

a first socket on said bearing element, at one end of said arcuate bearing race, for receiving said ball when the armrest is in its first position;

a second socket on the bearing element, at the other end of the arcuate bearing race, for receiving said ball when the armrest is in its second position;

and groove means on said bearing race, between said first and second sockets, for guiding said bearing ball between said sockets;

said urging means comprising means normally holding said bearing ball in a socket and for permitting said bearing ball to be displaced from said socket in response to a predetermined unlocking force in the direction of said arcuate movement.

2. In a seat as recited in claim 1 wherein said connecting means comprises:

upper and lower extensions on said bearing element;

upper and lower pins on said upper and lower extensions respectively;

said upper and lower pins having a common axis;

means on said armrest mounting said armrest on said pins for pivotal movement of the armrest about the axis of said pins;

and means on said upper and lower extensions engaging said mounting means on the armrest to limit upward and downward movement of the armrest relative to said bearing element.

3. In a seat as recited in claim 1 wherein:

said first and second sockets are 180° apart on said arcuate bearing race.

4. In a seat as recited in claim 1 wherein said urging means for the bearing ball comprises:

spring means having one opposite end engaging said ball and another opposite end engaging said armrest;

said armrest comprising a housing containing said spring means.

5. In a seat as recited in claim 4 wherein;

said housing contains a substantial portion of said ball.

6. In a seat as recited in claim 1 wherein:

said mounting means for the link member comprises a bracket on said rigid frame:

and stop means on said link member and on said bracket cooperating to limit said pivotal movement of said link member in one direction to said horizontal disposition thereof and in the other direction to said vertical disposition thereof.

7. In a seat as recited in claim 6 wherein said stop means comprises:

a pin;

means mounting said pin on said link member for pivotal movement of the pin with the link member;

and a slot on said bracket for receiving said pin;

said slot having an arcuate shape corresponding to the arc of pivotal movement of said pin;

the opposite ends of said slot comprising means for engaging said pin to limit said pivotal movement.

* * * * *